United States Patent [19]

Guionie et al.

[11] 4,380,848

[45] Apr. 26, 1983

[54] STOP DEVICE FOR A PIVOTAL DOOR, IN PARTICULAR FOR AN AUTOMOBILE VEHICLE DOOR

[75] Inventors: Paul Guionie, Larche; Rene Roudier, Brive, both of France

[73] Assignee: Paumellerie Electrique, France

[21] Appl. No.: 244,720

[22] Filed: Mar. 17, 1981

Related U.S. Application Data

[63] Continuation-in-part of Ser. No. 84,071, Oct. 12, 1979, abandoned.

[30] Foreign Application Priority Data

Oct. 19, 1978 [FR] France ..... 78 29777
Mar. 17, 1980 [FR] France ..... 80 05870

[51] Int. Cl.[3] ..... E05F 5/06
[52] U.S. Cl. ..... 16/85; 16/327; 16/332
[58] Field of Search ..... 16/85, 327, 332, 335, 16/334, 337, 341, 352, 355, 374

[56] References Cited

U.S. PATENT DOCUMENTS

| | | | |
|---|---|---|---|
| 2,693,616 | 11/1954 | Cromwell et al. | 16/85 |
| 2,787,019 | 4/1957 | Galla | 16/85 |
| 3,837,040 | 9/1974 | Keller et al. | 16/85 X |

FOREIGN PATENT DOCUMENTS

| | | | |
|---|---|---|---|
| 1584227 | 8/1970 | Fed. Rep. of Germany | 16/85 |
| 1054608 | 2/1954 | France | 16/85 |
| 1133128 | 3/1957 | France | 16/85 |
| 1505703 | 3/1978 | United Kingdom | 16/85 |

*Primary Examiner*—Paul A. Bell
*Attorney, Agent, or Firm*—Robert E. Burns; Emmanuel J. Lobato; Bruce L. Adams

[57] ABSTRACT

Pivotally mounted on the door is an arm which has a stop recess in which there may be retained a fixed roller which is mounted in a bracket member fixed to the fixed post of the door. The arm is applied against the roller under the effect of a movable roller which is mounted on the bracket member and is biased into contact with the arm by a torsion spring which has two windings which are disposed symmetrically on each side of branches of the bracket member.

18 Claims, 16 Drawing Figures

STOP DEVICE FOR A PIVOTAL DOOR, IN PARTICULAR FOR AN AUTOMOBILE VEHICLE DOOR

DESCRIPTION

This application is a Continuation-In-Part of our application Ser. No. 84,071 of Oct. 12, 1979 now abandoned.

The present invention relates to a stop device for a pivotal door, lid or the like, comprising an arm adapted to be pivotally mounted, by means of a pin which is parallel to the pivot axis of the door, on one of the parts of the vehicle consisting of the door and the fixed post on which the door is mounted, this arm having the shape of a flat strip having two opposed edges against which edges there are applied two rollers which are mounted between parallel branches of a bracket member which is adapted to be fixed to the other part, one of said rollers being fixed and the other movable and mounted on a member forming a rocker which is pivotally mounted on the bracket member between the branches and is subjected to an elastically yieldable torque which creates a pressure of contact between each of the two rollers and the arm, the arm being provided with a stop recess for retaining the fixed roller in the open position of the door.

The object of the invention is to so improve this device, which is disclosed in British Pat. No. 1,505,703 as to provide a more rational construction implying an improved utilization of the material and improved working conditions which prolong the life of the device.

This object according to the invention is achieved by an arrangement wherein the branches of the bracket member are part of a U-sectioned centre portion on each side of which centre portion are symmetrically formed two large wing portions which are perpendicular to the branches, and in the region of which extend extensions of the mounting pin of the rocker, each of which extensions supports a helical winding forming a torsion spring the respective ends of which bear against an abutment of the corresponding wing portion and against the rocker, the transverse portion of the U, which is located adjacent the edge of the wing portions, being roughly perpendicular to the wing portions so that the pivotal arm which is engaged between the rollers can move while remaining spaced from the transverse portion of the U.

Apart from the fact that the large wing portions enable the bracket member to be fixed in a reliable manner on the corresponding part, for example on the fixed post of the body of a vehicle, which imparts thereto considerable rigidity and renders it insensitive to possible deformations of the sheet metal, the presence in the U-shaped centre portion of merely the rollers permits reducing to the maximum extent the dimensions of this portion, and in particular to the rocker, which in the known arrangement supports the torsion spring, while improving its rigidity and at the same time ensuring under good conditions the elastic torsional biasing of the rocker which, in acting laterally and symmetrically by means of two windings forming a spring whose fatigue is minimum, is particularly effective. The forces are well centered and perfectly balanced.

Another advantage is that the pivotal arm can undergo its movements exclusively through the openings formed between the branches of the centre portion of the bracket member while remaining at a distance from the transverse portion of the U, whereas in the known arrangement this transverse portion has an aperture in which the arm is engaged.

The windings preferably constitute a single spring which has a centre stirrup portion which bears against the rocker and interconnects the adjacent ends of the windings.

It is advantageous to arrange that the fixed roller be mounted in a narrow part of the U-shaped centre portion immediately adjacent to the transverse portion of the U and that the rocker be pivotally mounted in a wider part. This arrangement permits the use of a fixed roller and a movable roller which are identical and interchangeable.

The invention also provides another embodiment of the stop device wherein the movable roller is rotatably mounted on the transverse portion of the centre stirrup portion of the torsion spring so that it is directly subjected to the elastically yieldable torque.

This arrangement not only makes an economy of the part formed by the rocker but also simplifies the bracket member in that the two branches of the latter may have a uniform spacing.

The invention will be explained in the ensuing description with reference to the accompanying drawings in which.

In all these Figures, the invention is shown in its application to a vehicle door, but it will be clear that the stop device may be employed for other pivotal closing means of the vehicle, such as the bonnet of the engine, the lid of the luggage boot, a rear transverse door or the like, or even, in other types of the device, for example for lids of household apparatus, luggage cases, boxes or the like. The expression door is here employed in a very broad sense for designating the various pivotal closing means.

Figure 1:
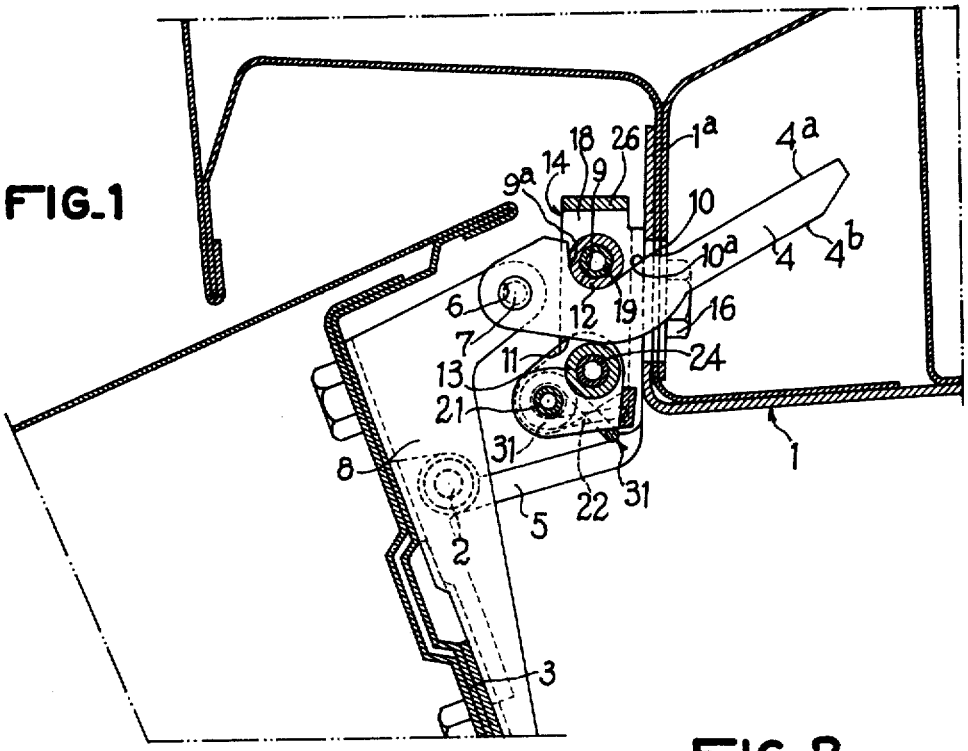
FIG. 1 is a horizontal sectional view of a door stop device comprising an arm in the form of a pivotally mounted strip whose plane is perpendicular to the pivot axis of the door, assumed to be open, and a rocker which is biased by a torsion spring and is carried by a bracket member fixed to the body.

FIG. 1 represents a body post 1 on which the left front door 3 is pivotally mounted by means of hinges the pin 2 of which extends through hinge members 5 only one of which is shown and which are respectively fixed to the post 1 and to the door 3. The latter is retained in the open position by a stop device which comprises an arm 4 in the form of a flat strip one of the ends of which is provided with an aperture 6 through which is engaged a pivot pin 7 which is parallel to the pin 2 and rigid with a bracket 8 fixed to the door 3. In the vicinity of this end, the arm 4 has on its front edge 4*a* a stop recess 9 in which is engageable, in the position corresponding to the end of the opening, a roller 12 carried by a bracket member 14 which is fixed by bolts 16 to one of the sheet metal parts 1*a* constituting the post 1 through which post the arm 4 extends. The front edge 4*a* of the arm 4 is urged against the roller 12, which is fixed, by an opposing roller 13 which is also carried by the bracket member 14 and elastically urged against the rear edge 4*b* of the arm 4.

The bracket member 14 is in the general shape of a plate defined by two large planar wing portions 17 the shape of which is substantially that of a quadrilateral and which are applied against the sheet 1*a* and are provided at 17*a* with apertures for the passage of fixing bolts 16. The two wing portions 17 extend symmetrically on each side of a centre U-shaped portion 15 obtained by a folding operation and having two branches 18 which are perpendicular to the wing portions and serve to mount two pins 19, 21, on one of which the fixed roller 12 is rotatably mounted whereas the other pin constitutes a pivot for mounting a pivotal member or rocker 22 which also has a U-shape and two branches 23 through which extend the pin 21 and a pin 24 on which the roller 13 is freely rotatable.

The transverse portion 26 of the U-shaped centre portion 15 is roughly perpendicular to the wing portions 17 and is located adjacent to an edge of the latter, so that the arm 4 is movable between the branches 18 without any interference with the transverse portion 26 from which it is permanently spaced. The part 18*a* of the branches 18, which is adjacent to the transverse portion 26 and serves to mount the fixed roller 12, is nearer to the plane of symmetry X—X than the part 18*b* which adjoins it and serves to mount the rocker 22. It is thus possible to employ rollers 12 and 13 which have identical dimensions.

The pin 21 for mounting the rocker 22 extends beyond the part 18*b* of the branches of the U 15 and constitutes two extensions 27 which extend in the region of the respective wing portions 17 and around each of which is engaged a helical winding 28 which has a free end anchored against a flange 29 at a right angle to the corresponding wing portion 17 and which is part of a torsion spring 31 whose centre portion forms a stirrup 32 which interconnects the adjacent ends of the two windings and bears against the branches 23 of the rocker 22.

Figure 2:
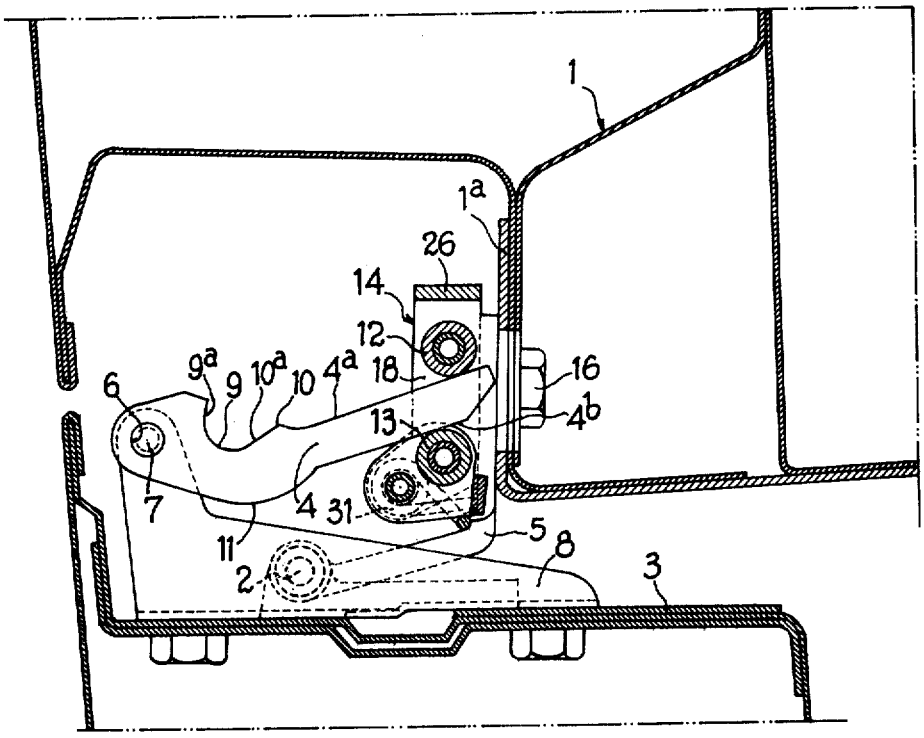
FIGS. 2 and 3 are corresponding views of respectively the closed position and intermediate position of the door.
Figure 4:
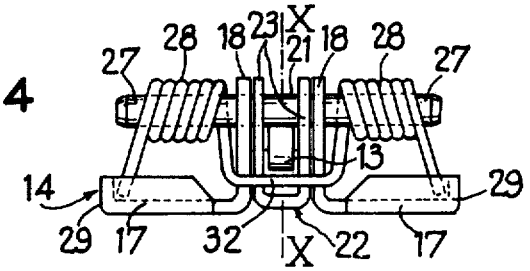
FIGS. 4, 5 and 6 are respectively an end view, plan view and a side view of the bracket member.
Figure 5:
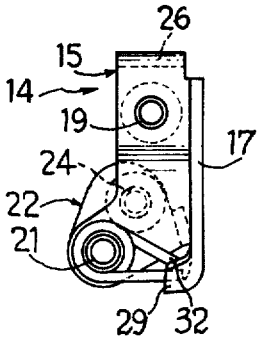
Figure 6:
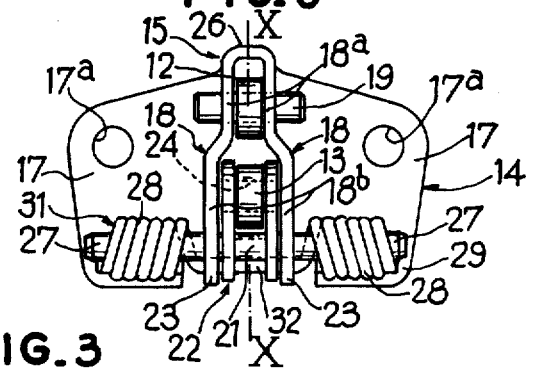
Figure 3:
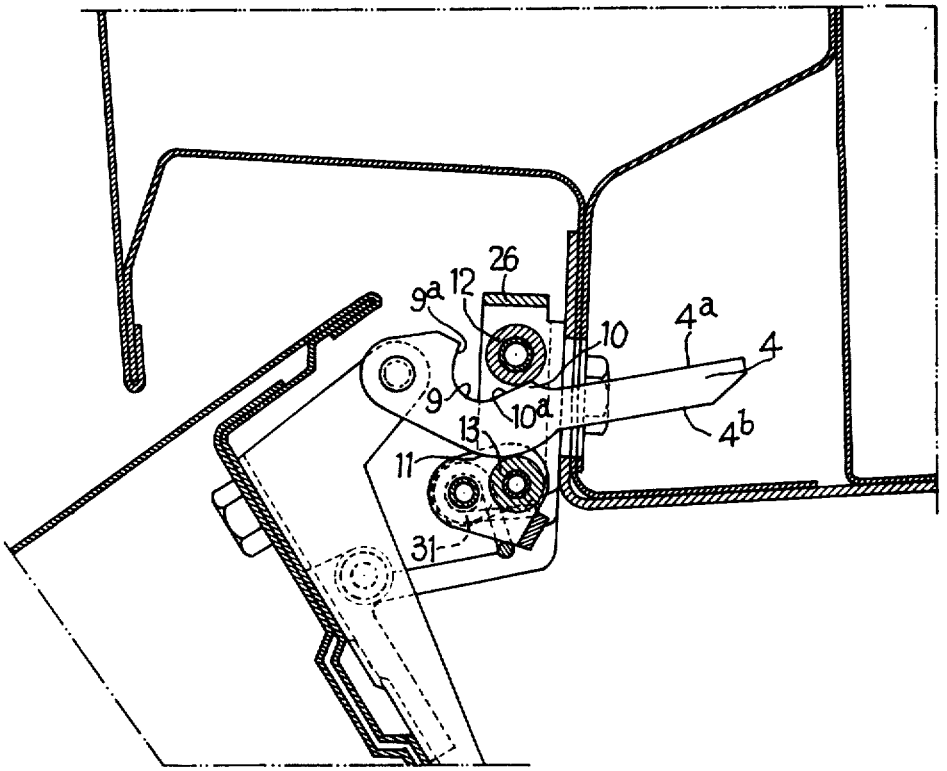

Under the action of the torque thus created, the two rollers 12 and 13 are applied under pressure against the edges 4*a*, 4*b* of the arm 4. In the closed position shown in FIG. 2, the two rollers bear against a rectilinear part of the edges 4*a*, 4*b*, and the torque required to be exerted to open the door is very low. Toward the end of the opening travel, the rollers 12, 13 must respectively pass over the boss 10 having an angular profile formed on the edge 4*a*, and the region 11 having a convex curvature of the edge 4*b*, before the roller 12 finally drops into the stop recess 9 which retains the roller in a positive manner by means of its end side 9*a*. In this fully open position, in order to close the door, a relatively considerable torque must be exerted in opposition to the retaining action of the adjacent ramp 10*a* of the boss 10.

Figure 7:
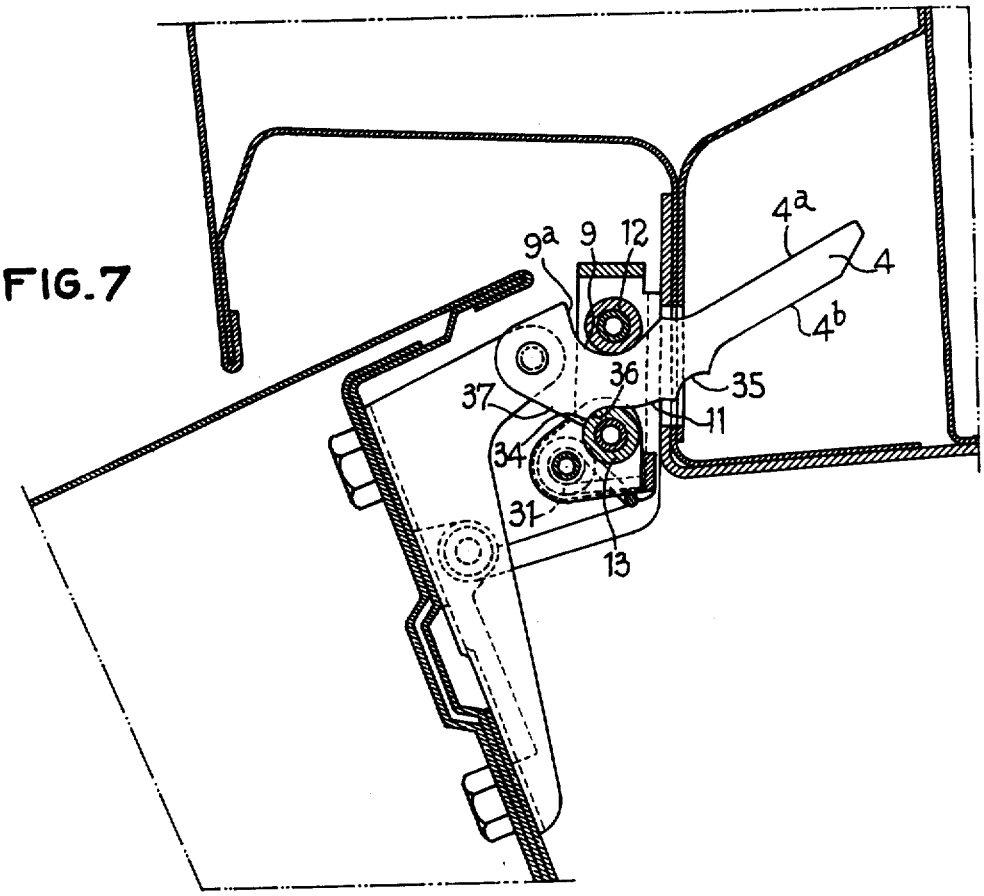
FIG. 7 is a view corresponding to FIG. 1 of a modification in which the stop position is defined by an elastic abutment.

In FIG. 7, the region 11 is extended so as to form also a boss 34 having an angular profile defined by a concave part 36 which is connected to the concave part 11 and by a rectilinear ramp 37. The angular boss 34 adjacent to the convex part 11 has such position that the movement for opening the door normally ends at the moment when the rear roller 13 abuts against the concave part 36 of the boss 34, the door being then retained by the front roller 12 which is engaged in the stop recess 9 but does not contact the end side 9*a* of the recess 9. This concerns an elastic retaining effect in that it may be overcome by overcoming the action of the spring 31 then, in starting at the position reached in FIG. 7, a sufficient torque is exerted on the door, so that the boss 34 is passed over and a final positive retaining position is reached by abutment of the front roller 12 with the end side 9*a* of the stop recess 9.

The elastic retaining action has the advantage of resulting in a smooth motion of the door and reducing the fatigue of the component parts of the mechanism and neighbouring sheet metal.

In FIG. 7, the edge 4*b* also has an auxiliary stop recess 35 corresponding to the partial opening position or parking position of the door.

Figure 8:
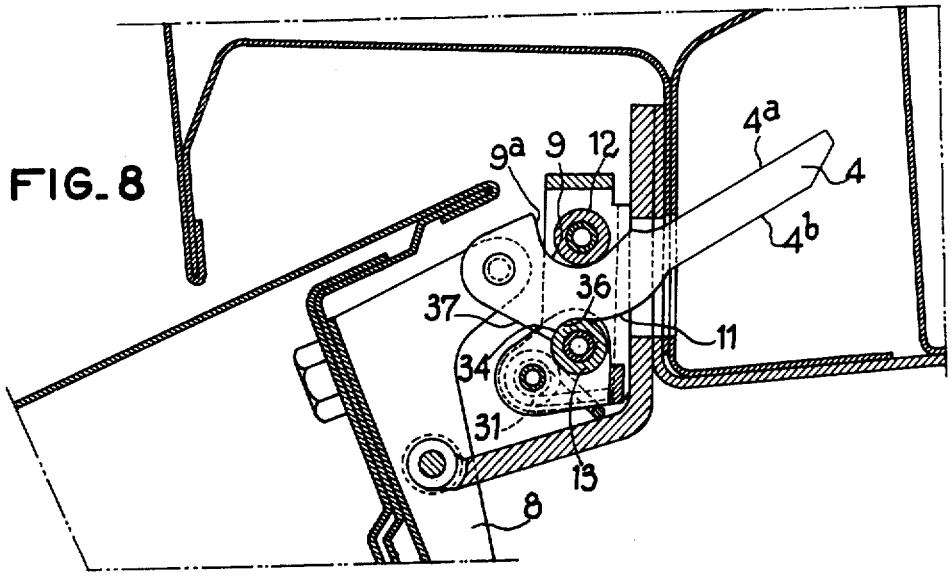
FIG. 8 is a view similar to FIG. 1 of a modification in which the door stop device is incorporated in the hinge.

In all these foregoing embodiments, the door stop is independent of the hinge members 5 of each hinge which are interconnected by a pin 2, the bracket member 14 and the bracket 8 being directly fixed to the fixed post 1 and to the door 3 respectively. It is of course possible to integrate the door stop in one of the hinges or even to provide a door stop in each hinge. In this case, the bracket member 14 and the bracket 8 are fixed to corresponding hinge members, as shown in FIG. 8.

In the embodiments shown in FIGS. 1 and 7, the pin pivotally mounting the arm 4 on the bracket 8 is disposed in such manner relative to the pivot pin 2 of the door 3 that, during the opening movement, the pin 7 moves toward the fixed post 1 and enters the latter. The reverse arrangement is shown in FIGS. 9 and 10 which correspond to the case where the arm is drawn out of the fixed post during the opening movement.

The arm 40 then has on its front edge 40*a* a stop recess 49 in the vicinity of its free end, that is to say at the end opposed to the pivot pin 7. This stop recess 49 is defined by a boss 41 having an angular profile, on one hand, and by the edge 49*a* of the forwardly curved end portion 42 on the arm 40 on the other hand. The rear edge 40*b* of the arm 40 is substantially rectilinear but terminates in a curved part 43 in the region of the end portion 42. An intermediate or parking stop recess 45 is also provided.

Figure 9:
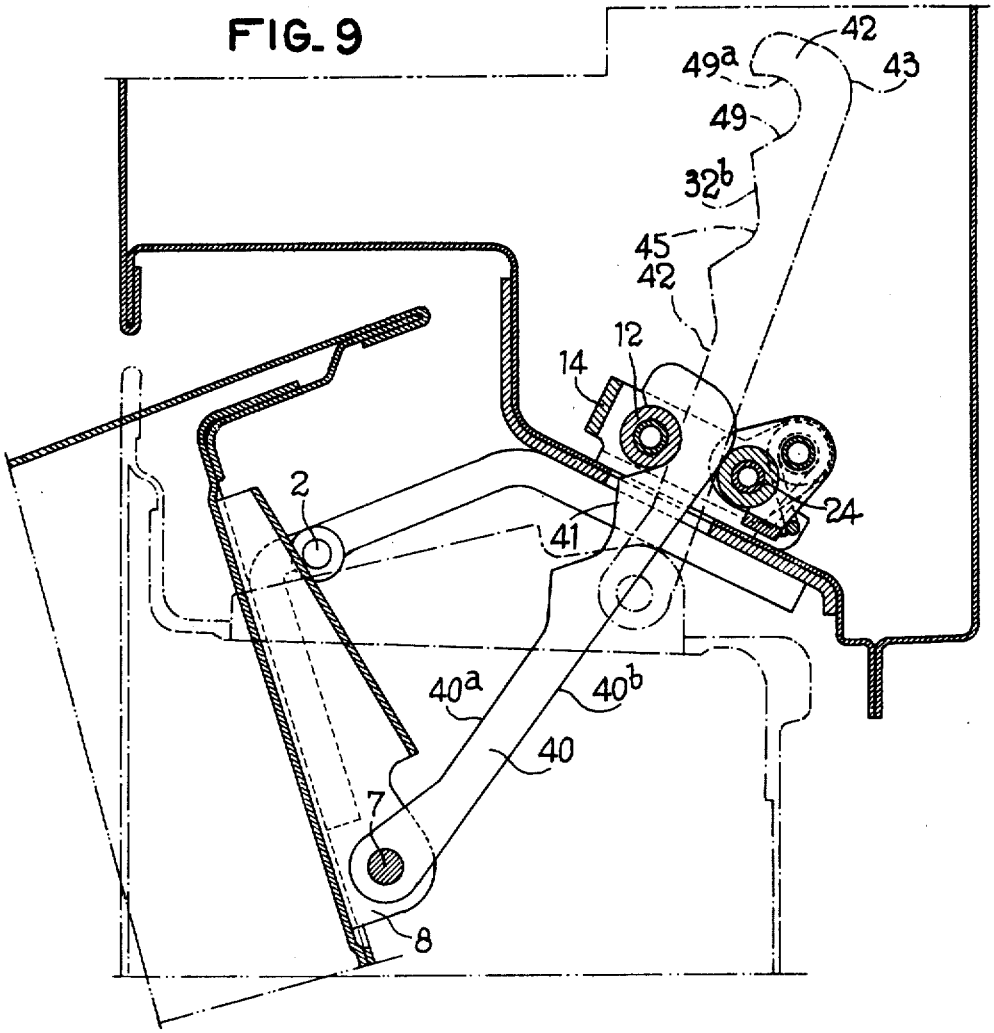
FIG. 9 is a view similar to FIG. 1 of another modification in which the arm in the form of a strip is pulled out of the fixed post when the door is opened.
Figure 10:
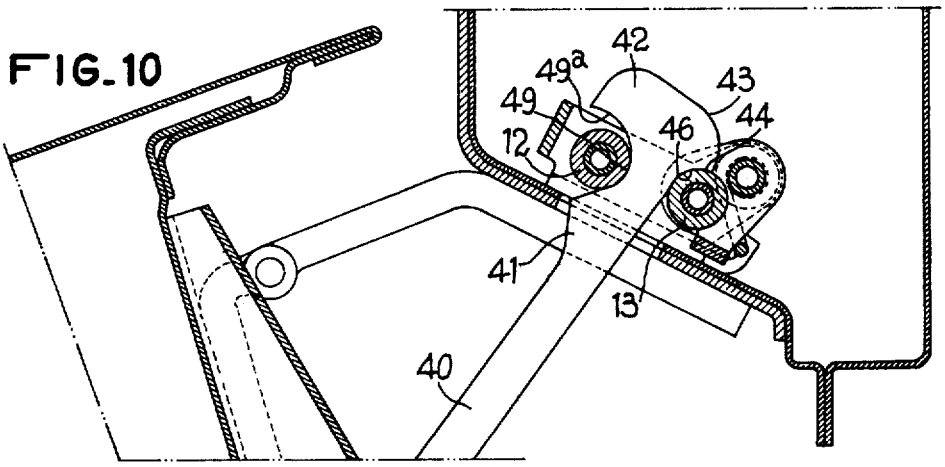
FIG. 10 is a view similar to FIG. 9 in which the stop position is defined by an elastic abutment.

The bracket member 40 is mounted inside the post 1 and, when the door is closed, the whole of the arm 40 is inserted in this post, its rectilinear part being in contact with the rollers 12 and 13, as shown in dot-dash lines in FIG. 9. When the door is opened, the arm 40 slides between the rollers 12 and 13 which must pass beyond the angular boss 41 before the roller 12 drops into the recess 49 which retains it by means of its end side 49*a* in the same way as the recess 9.

It will be understood that the arm 40 may also have an elastic retaining action. The latter is preferably (FIG. 10) formed by a boss 44 having an angular profile defined by a concave part 46 connected to the convex curved part 43 and to the rectilinear edge 40*b*.

Figure 11:
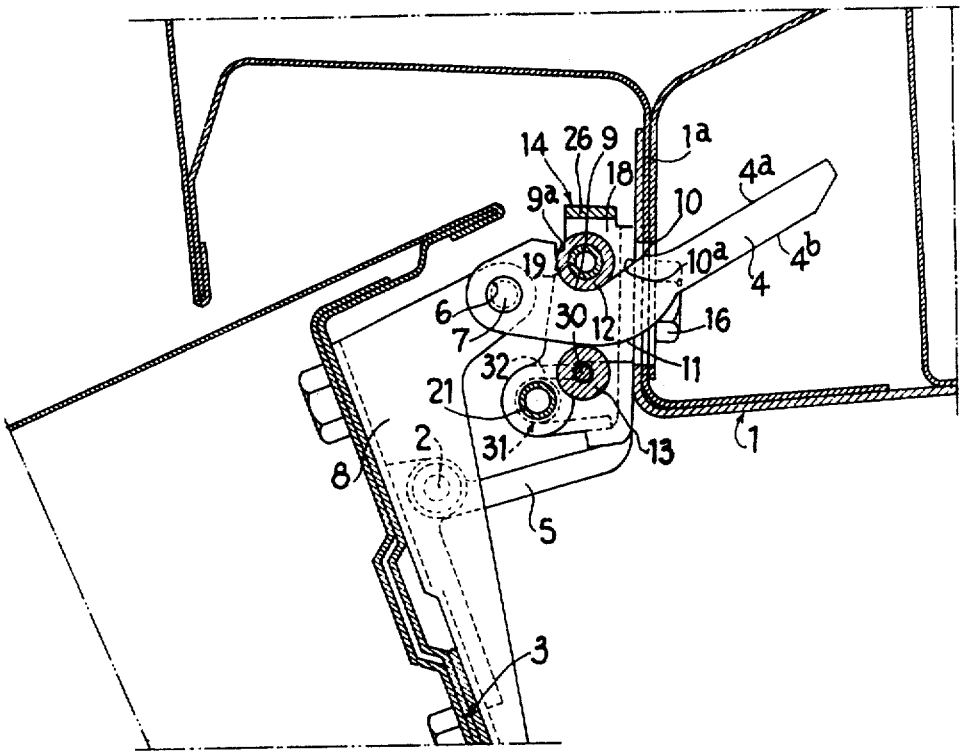
FIG. 11 is a horizontal sectional view of a door stop device comprising a pivotal arm and two rollers, one of which is mounted on the transverse portion of the torsion spring.

FIG. 11 represents a body post 1 on which the left front door 3 is pivotally mounted by means of hinges, the pin 2 of which extends through hinge members 5 respectively fixed on the post 1 and on the door 3. The latter is retained in the open position by a stop device which comprises an arm in the form of a flat strip 4 one of the ends of which is provided with an aperture 6 through which is engaged a pivot pin 7 which is parallel to the pin 2 and rigid with a bracket 8 fixed to the door 3. In the vicinity of this end, the arm 4 has on its front edge 4*a* a stop recess 9 in which is engageable, in the position corresponding to the end of the opening, a roller 12 carried by a bracket member 14 which is fixed by means of bolts 16 to one of the sheet metal parts 1*a* constituting the post 1 through which the arm 4 extends. The front edge 4*a* of the arm is urged against the roller 12, which is fixed, by an opposing roller 13 which is also carried by the bracket member 14 and is elastically urged against the rear edge 4*b* of the arm 4.

The bracket member 14 has the general shape of a plate defined by two large planar wing portions 17 the shape of which is substantially that of a quadrilateral and which are applied against the sheet 1*a* and are provided at 17*a* with apertures for the passage of fixing bolts 16. The two wing portions 17 extend symmetrically on each side of a centre U-shaped portion obtained by a folding operation and having two branches 18 which are perpendicular to the wing portions and are uniformly spaced from the plane of symmetry XX and serve to mount the two pins 19, 21, the pin 19 rotatively supporting the fixed roller 12 and the other pin 21 extending distinctly beyond the branches of the U and constituting two extensions 27 which extend in the region of the respective wing portions 17 and about which a helical winding 28 is engaged. This winding has a free end anchored against a flange 29 at a right angle to the corresponding wind portion 17, this end being part of a torsion spring 21 whose centre portion forms a stirrup 32 which interconnects the adjacent ends of the two windings. Rotatively mounted on the transverse portion 30 is the roller 13 which is thus directly subjected to the elastically yieldable torque produced by the spring 31.

The transverse portion 26 of the U-shaped centre portion 15 is roughly perpendicular to the wing portions 17 and is located in a marginal position relative to the wing portions so that the arm 4 is able to move between the branches 18 with no interference with the transverse portion 26 from which it is always spaced.

Under the action of the torque exerted by the transverse portion 30 of the spring 31, the two rollers 12 and 13 are applied with pressure against the edges 4*a*, 4*b* of the arm 4. In the closed position (not shown), the two rollers bear against a rectilinear part of the edges 4*a*, 4*b* so that the torque to be exerted to open the door is very low. Toward the end of the opening travel, the rollers 12, 13 must respectively pass over a boss having an angular profile 10 formed on the edge 4*a* and the region 11 having a convex curvature of the edge 4*b*, before the roller 12 finally drops into the stop recess 9 which retains the roller in a positive manner by means of its end side 9*a* as shown in FIG. 11. In order to close the door from this fully open position, a relatively large torque must be exerted against the retaining action exerted by the adjacent ramp 10*a* of the boss 10.

Figure 15:
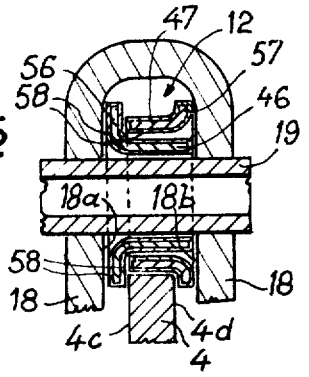
FIG. 15 is a sectional view of a particular embodiment of the rollers.
Figure 12:
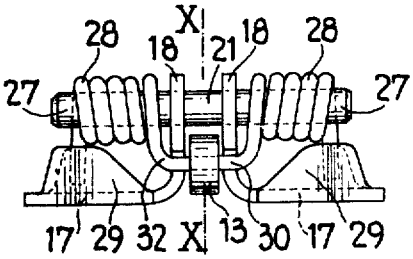
FIGS. 12, 13 and 14 are an end elevational, a plan and a side elevational view respectively of the bracket member of the door stop device of FIG. 11.
Figure 13:
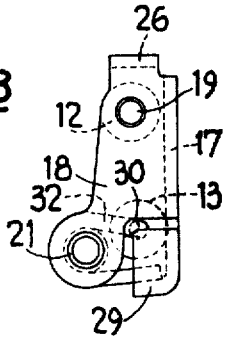
Figure 14:
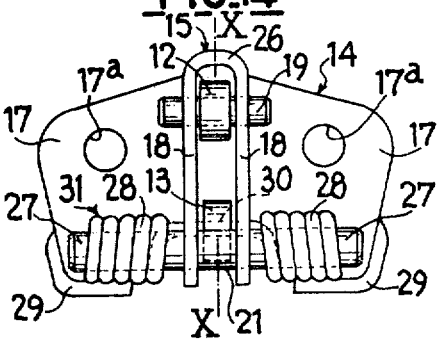

In the embodiment shown in FIGS. 1 to 14, the rollers 12, 13 are solid rollers of conventional construction. FIG. 15 shows a modification of a roller 12 which results inappreciable advantages in the application to the door stop according to the invention. The roller 12 shown in FIG. 15 comprises two cylindrical rings 46, 47 of treated steel, each of which comprises at one end a planar flange 56, 57 extending radially outwardly. The rings 46 and 47 are fitted one inside the other. The radial dimension of the flange 56 of the inner ring 46 is such that it extends beyond the cylindrical surface of the outer ring 47. The two rings consequently have a radially slidable contact between their adjacent cylindrical surfaces and, possibly, an axially slidable contact between the flange-free end of the outer ring 47 and the flange 56 of the inner ring. A coating 58 of polytetrafluoroethylene, or some other material having a low coefficient of friction, is applied on the surface of the two rings 46, 47 so as to improve the sliding properties, not only between the two rings, but also between the inner ring 46 and pin 19 and between the flanges 56, 57 and, on one hand, the inner surfaces 18*a*, 18*b* of the branches 18 of the bracket member 14, and, on the other hand, the lateral surfaces 4*c*, 4*d* of the pivotal arm 4. It will be understood that the roller 13 in all Figures may be identical to the roller 12 of FIG. 15.

In the embodiment described in FIGS. 11 to 14, the pin 7 pivotally mounting the arm 4 on the bracket 8 is disposed in such manner relative to the pivot pin 2 of the door 3 that, during the opening movement, the pin 7 moves toward the bracket member 14 so that the arm 4 is urged toward the fixed post 1 and enters the latter. The reverse arrangement is shown in FIG. 16 which corresponds to the case where the arm is drawn out of the fixed post during the opening movement.

In this case, the arm 40 has on its front edge 40*a* a stop recess 49 in the vicinity of its free and 42, i.e. at the end opposed to the pivot pin 7. This stop recess 49 is defined by a boss 41 having an angular profile, on one hand, and by the edge 49*a* of the forwardly curved end portion 42 on the arm 40 on the other hand. The rear edge 40*b* of the arm 40 is substantially rectilinear but terminates in a curved part 43 in the region of the end portion 42 which acts as a stop in the door opening direction.

Figure 16:
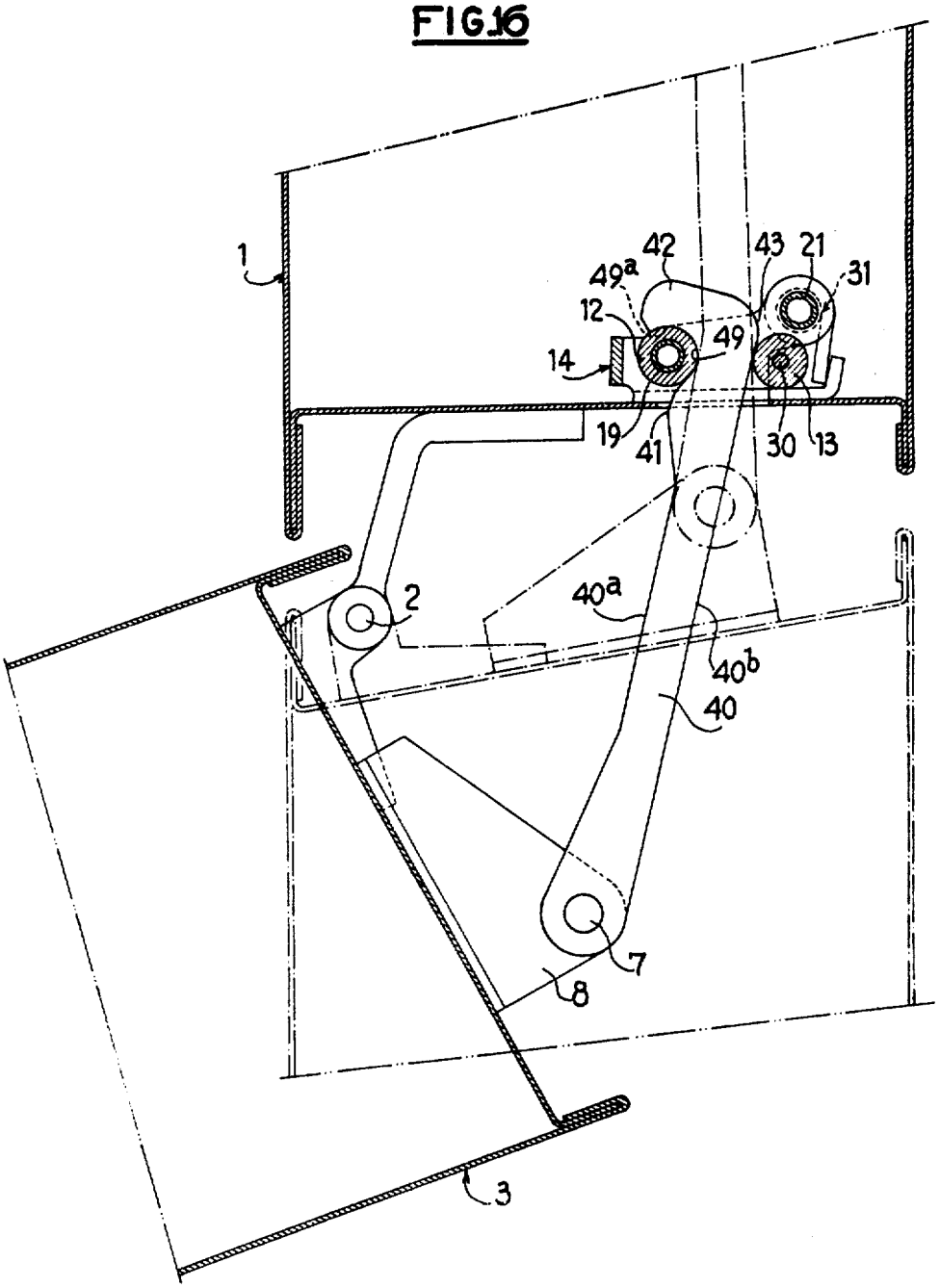
FIG. 16 is a view of a modification of the door stop device of FIG. 11 in which the arm is pulled out of the fixed post when opening the door.

The bracket member 14 is mounted inside the post 1 and, when the door is closed, the whole of the arm 40 is urged into this post, its rectilinear part being in contact with the rollers 12 and 13, as shown in dot-dash lines in FIG. 16. When the door is opened, the arm 40 slips between the two rollers 12 and 13 which must pass over the angular boss 41 before the roller 12 can drop into the recess 49 which retains it by means of its end side 49*a* in the same way as the recess 9.

Having now described out invention what We claim as new and desire to secure by Letters Patent is:

1. In a stop device for combination with two parts which consist of a door post and a door mounted on the post to pivot about a pivot axis, the device comprising an arm for mounting on one of said parts to pivot about an axis parallel to said pivot axis and having two opposed edges, a bracket member for fixing to the other of said parts and comprising two parallel branches, two rollers mounted between the parallel branches of the bracket member, one of the rollers being fixed in translation relative to the bracket member and the other roller being movable in translation relative to the bracket member, a rocker, a pin pivotally mounting the rocker between the branches of the bracket member, the movable roller being mounted on the rocker, elastically yieldable means for subjecting the rocker to an elastic torque which creates a pressure of contact between each of the two rollers and the opposed edges of the arm, the arm defining a stop recess for receiving and retaining the fixed roller in the open position of the door: the improvement wherein the branches of the bracket member are part of a U-section centre portion of the bracket member and two large wing portions extend symmetrically from each side of the centre portion in a direction perpendicular to the branches, said pin having two portions extending beyond the branches in the region of the wing portions, said elastically yieldable means comprising two helical windings which form a torsion spring and are respectively mounted on each of said two pin portions and have a first portion which bears against the corresponding wing portion which includes an abutment for said first portion, and a second portion which bears against the rocker, the U-section centre portion comprising a transverse portion which is located adjacent an edge of the wing portions and is substantially perpendicular to the wing portions so that the pivotal arm engaged between the two rollers can move while remaining spaced away from said transverse portion of the U-section centre portion.

2. A device as claimed in claim 1, wherein the two helical windings are part of a single torsion spring which comprises a centre stirrup portion which bears against the branches of the rocker and interconnects adjacent ends of the windings.

3. A device as claimed in claim 1, wherein said abutment of each wing portion comprises a flange which is substantially at a right angle to the corresponding wing portion.

4. A device as claimed in claim 1, 2 or 3, wherein the U-sectioned centre portion of the bracket member comprises a first part adjacent to the transverse portion between the branches of which first part the fixed roller is mounted and a second part which is wider than said first part between the branches of which second part the rocker is pivotally mounted.

5. A device as claimed in claim 1, 2 or 3, wherein the stop recess which receives the fixed roller is formed in one of said two opposed edges of the arm and comprises a ramp portion which defines an angular boss and an end side portion constituting a positive abutment for the fixed roller.

6. A device as claimed in claim 5, wherein the other of said two edges of the arm has a region having a convex curvature in the region of the boss.

7. A device as claimed in claim 6, comprising, connected to said region of convex curvature of the edge, a concave side of an angular boss which forms an elastic abutment for the movable roller when, the door in the open position, the fixed roller is engaged in the stop recess without being in contact with said end side portion.

8. A device as claimed in claim 1, 2 or 3, for an arrangement in which the arm is progressively inserted in said other of said parts during the opening of the door, wherein the stop recess is disposed in the vicinity of an end of the arm which is adapted to be pivotally mounted on said one of said parts.

9. A device as claimed in claim 8, wherein said one of said parts is the door.

10. A device as claimed in claim 1, 2 or 3, for an arrangement in which the arm is drawn out of said other of said parts during the opening of the door, wherein the stop recess is disposed in the vicinity of an end of the arm opposed to the end adapted to be pivotally mounted on said one of said parts.

11. A device as claimed in claim 10, wherein said one of said parts is the door.

12. A device as claimed in claim 1, 2 or 3, comprising an intermediate stop recess on the arm corresponding to a partly-opened position of the door.

13. A device as claimed in claim 1, 2 or 3, wherein each roller comprises two cylindrical rings which are fitted one inside the other, each ring having at one end a planar flange extending radially outwardly of the ring, the flange of the inner ring having such radial dimension that it extends beyond the cylindrical surface of the outer ring so that a sliding contact is provided not only radially between the two rings but also axially between the ring flanges and the lateral surfaces of the pivotal arm.

14. A device as claimed in claim 13, wherein the two rings are provided with a coating of a material having a low coefficient of friction.

15. A stop device for a pivotal door, comprising an arm adapted to be pivotally mounted, by means of a pin parallel to the pivot pin of the door, on one of two parts consisting of the door and the fixed post on which the door is mounted, said arm having the shape of a strip having opposed edges against which edges are applied two rollers which are mounted between parallel branches of a bracket member which is adapted to be fixed to the other part of said two parts, one of the rollers being fixed and the other roller being movable and subjected to an elastically yieldable torque which creates a pressure of contact between each of the two rollers and the arm, the arm being provided with a stop recess for retaining the fixed roller in the open position of the door, the elastically yieldable torque being produced by a torsion spring comprising a centre stirrup portion interconnecting adjacent ends of two helical windings which are mounted symmetrically on each side of the branches of the bracket member about extensions of a pin which extends through the branches of the bracket member, which branches are part of a U-sectioned centre portion of the bracket member on each side of which centre portion are symmetrically formed two large wing portions which are perpendicular to the branches and have two spaced-apart abutments against which abutments bear ends of the respective windings opposed to the branches, the U having a transverse portion which is roughly perpendicular to the wing portions so that the pivotal arm engaged between the rollers is capable of moving while remaining spaced away from the transverse portion of the U, wherein the movable roller is rotatively mounted on a transverse portion of the centre stirrup portion of the torsion spring so that it is directly subjected to the elastically yieldable torque.

16. A device according to claim 15, wherein the distance between the branches of the U-sectioned centre portion of the bracket member is constant.

17. A device according to claim 15 or 16, wherein each roller comprises two cylindrical rings which are fitted one inside the other, each ring having at one end a planar flange extending radially outwardly of the ring, the flange of the inner ring having such radial dimension that it extends beyond the cylindrical surface of the outer ring so that a sliding contact is provided not only radially between the two rings but also axially between the ring flanges and the lateral surfaces of the pivotal arm.

18. A device according to claim 17, wherein the two rings are provided with a coating of a material having a low coefficient of friction.

* * * * *